US005845760A

United States Patent [19]

Schmidke et al.

[11] Patent Number: 5,845,760

[45] Date of Patent: Dec. 8, 1998

[54] CHEESE CONVEYING SYSTEM

[75] Inventors: Waldemar Schmidke, Aachen; Jürgen Backhaus, Wegberg; Hans-Peter Liedgens; Joachim Pospiech, both of Mönchengladbach, all of Germany

[73] Assignee: W. Schlafhorst AG & Co., Germany

[21] Appl. No.: 717,919

[22] Filed: Sep. 23, 1996

[30] Foreign Application Priority Data

Sep. 23, 1995 [DE] Germany ..... 195 35 435.4

[51] Int. Cl.[6] ..... B65G 47/68

[52] U.S. Cl. ..... 198/448; 198/357; 242/35.5 A

[58] Field of Search ..... 198/448, 357; 242/35.5 A

[56] References Cited

U.S. PATENT DOCUMENTS

| | | | |
|---|---|---|---|
| 1,922,717 | 8/1933 | Smitt | 198/448 |
| 4,044,897 | 8/1977 | Maxted | 198/448 |
| 4,925,000 | 5/1990 | Pacakova et al. | 198/448 |
| 5,267,638 | 12/1993 | Doane | 198/357 |

FOREIGN PATENT DOCUMENTS

| | | |
|---|---|---|
| 0 061 432 A1 | 3/1982 | European Pat. Off. . |
| 0 500 389 A1 | 2/1992 | European Pat. Off. . |
| 35 32 915 A1 | 9/1985 | Germany . |
| 39 12 683 A1 | 4/1989 | Germany . |
| 42 22 723 A1 | 7/1992 | Germany . |

*Primary Examiner*—Joseph E. Valenza
*Attorney, Agent, or Firm*—Kennedy Covington Lobdell & Hickman, LLP

[57] ABSTRACT

A cheese conveying system has an interface belt centrally trough-shaped along its length and disposed to span between the outlets of two delivery belts and to extend therefrom to the inlet of a collection belt, by means of which cheeses transported from the delivery belts in a lying position roll transversely to the center of the interface belt to accomplish a gentle uncomplicated transfer of the bobbins from the delivery belts to the collection belt. The delivery belts are alternately actuable and the respectively delivery, interface and collecting belts are driven at the same speed.

6 Claims, 4 Drawing Sheets

III
III

CHEESE CONVEYING SYSTEM

FIELD OF THE INVENTION

The present invention relates to a cheese conveying system with a junction or interface interposed between the outlets of at least two delivery belts and the inlet of a collecting belt, by means of which textile cheeses or bobbins can be transferred.

BACKGROUND OF THE INVENTION

Various types of textile machines, such as spinning frames or winding frames, deposit finished cheeses or bobbins on a conveyor belt. Many of these machines have a plurality of spinning or winding stations aligned along each opposite side of the machine and utilize one conveyor belt along each longitudinal side for servicing the spinning or winding stations therealong, which over time is filled with the produced cheeses. The instant invention is primarily concerned with the transport of cheeses which have yarn wound about the surface of a bobbin tube and are transferred to a conveying belt such that their tubes or winding axes are placed approximately in the conveying direction of the belt and such that the bobbin can roll, if necessary, transversely with respect to the conveying direction of the belt. The bobbins are passed on in this position with the aid of the conveyor belt which is also serves as a delivery belt for the following operation.

As soon as the respective delivery belt is filled with bobbins, it is cleared. In the process, the bobbins reach an intermediate storage position or station for further processing. Clearing of the cheeses or bobbins can be performed manually, but, in general, an automatic operation is performed wherein the bobbins are transported to a collecting belt via an interface. Because the bobbins are lying on their yarn surface, it is necessary to take the vulnerability of their yarn into consideration during their further transport. With each start of the delivery belt, the sensitive surface of the wound yarn can be negatively affected. Therefore the respective delivery belt is only actuated when the entire belt is to be cleared. In addition, the deflection of the individual bobbins from the belt should be performed in such a way that if possible no friction is exerted on the yarn surface.

In such textile machines having a delivery belt on each longitudinal side, it is accordingly necessary to assign a clearing interface or junction to each of these delivery belts as a connection with the collecting belt. However, in accordance with German Patent Publication DE 39 12 683 A1 it is also possible to utilize only one main collecting belt between the outlet of the one delivery belt and the inlet of the collecting belt, provided a transfer line to the main collection belt is associated with the outlet of the other delivery belt of the same machine. On such a transfer line the individual bobbin is first cleared from the respective delivery belt and is then transferred to the main collecting belt by rolling it to the side. However, the appropriate mechanical devices for doing so are very expensive and the bobbins can be injured in the course of the lateral transfer.

In order to meet these problems, it is possible in accordance with European Patent Publication EP 0 500 389 A1 to place the bobbins on transport pallets, so that the bobbins themselves do not touch the belt but instead are placed in an upstanding disposition on a peg fastened approximately perpendicularly to the transport pallet. In this case, the bobbins from two or more delivery belts can be transferred onto a collecting belt via a triangular lapping shunt, along which the transport pallets slide after leaving each respective delivery belt. However, this method not only requires additional transport pallets, but also a mechanical device for placing the tubes of the respective bobbins onto the pegs of the transport pallets so that the tubes stand perpendicularly with respect to the belt.

OBJECT AND SUMMARY OF THE INVENTION

It is accordingly an object of the present invention to provide an improved cheese conveying system with an interface or junction disposed between the outlets of at least two delivery belts and the inlet of a collecting belt, by means of which textile bobbins in the form of cheeses may be transported in a position lying on their yarn surface and transferred from such position while preventing damage to the wound yarn surface to the greatest possible extent without the need to employ special transport pallets or like devices and without the use of complicated lapping lines for lateral insertion of a transport line into a main line (DE 39 12 683 A1).

This object is attained in accordance with the invention by means of a textile cheese conveying system comprising at least two delivery belts each having a bobbin delivery outlet end, a collecting belt having a bobbin receiving end, and an interface interposed between the outlet ends of the delivery belts and the inlet end of the collecting belt for transferring bobbins from the delivery belts to the collecting belt. According to the present invention, the interface includes an interface belt having a transverse extent spanning between the outlet ends of the delivery belts for receiving bobbins from both thereof. The interface belt is of a trough shape in transverse cross-section to define a central bobbin collecting depression extending longitudinally along the interface belt and for inducing bobbins transferred onto the interface belt to roll transversely into the depression. Appropriate means is provided for alternately actuating the delivery belts, and means is also provided for actuating the interface belt and the delivery belts substantially at the same speed.

Thus, a conveyor belt is created by means of the present invention which serves as a junction or interface effective to unite textile bobbins from two or more delivery belts of a textile machine preparing cheeses and to supply the bobbins to a single collecting belt. In accordance with the invention, a Y-shaped belt as described hereinafter is used as the interface.

Depending on the type of machine it can also be necessary to insert an additional pivotable conveyor belt into the connection between the bobbin delivery system of the textile machine and the bobbin collecting system of the textile mill, which is pivoted away during normal operation of the machine, for example to make space for a circulating bobbin changer or a piecing carriage. The junction/interface belt in accordance with the present invention is preferably inserted between this pivotable conveyor belt, which may be designated as an "I-belt" for shorthand purposes, and the outlets of the delivery belts. The junction/interface belt is designed and operated in such a way that a gentle transfer of the bobbin lying on its surface from the delivery belts to the lapping belt and from the latter to the I-belt is possible. For this reason the belt speeds are strictly synchronized in accordance with the invention, i.e., the surfaces of successive belts have the same circulating speed.

In a preferred embodiment, the junction/interface belt is a conveyor belt defining in its lateral or transverse cross-section a slightly depressed trough, preferably in a Y-shape, and is sufficiently wide in its lateral dimension to extend between the outlets of at least two delivery belts of a cheese-producing textile machine. As a result of the orientation of their tubes in the longitudinal direction of the belt, the cheeses transferred to the Y-belt follow its trough shape and thereby roll on it to the lengthwise center of the belt. The trough is particularly designed to be sufficiently deep that each delivered bobbin comes to rest gently in the center of this belt by no later than the time required to reach the outlet of the Y-belt.

In accordance with the invention, the Y-belt is driven at the same speed as the delivery belts bringing the bobbins. For this reason it is practical to connect the same drive unit to the successive belts. The drive of the Y-belt can preferably be achieved with the aid of a toothed belt on a toothed belt pulley connected via a free-wheeling device or a coupling device with the drive shaft of the delivery belts whereby the successive belts necessarily have the same speed. In the course of operating the cheese-producing textile machine, the delivery belts as a rule are cleared sequentially rather than simultaneously. The next delivery belt is engaged only when the delivery belt of one machine is empty. With the use of an appropriate free-wheeling or coupling device, it can be accomplished that initially one delivery belt is driven at the same speed as the interface belt, while the other delivery belt stands still. Subsequently the first delivery belt is stopped and the second delivery belt is actuated at the same speed as the Y-belt.

An embodiment is also possible in which the first-cleared delivery belt continues to run while the second delivery belt is subsequently cleared. In such case a free-wheeling or coupling device is only needed on one of the delivery belts.

Instead of a connection of the Y-belt with the delivery belts by means of free-wheeling or coupling devices, a variant is contemplated wherein the delivery belts and the Y-belt have separate respective drive units, which drive the belts at the same circulating speed and are controlled by means of a control device.

In each embodiment, the bobbins reach a collection belt, which is a part of the textile mill, from the junction/interface belt, for example, via the aforementioned pivotably arranged I-belt and possibly via further intermediate belts, such as a curvilinear conveyor belt. The collecting belt transports the cheeses to a bobbin storage location, a shipping station or to a downstream processing device. Since all conveyor belts are driven at the same speed, no damage of the bobbin surface occurs either in the transfer of the cheeses from the delivery belts to the Y-belt, or the transfer from the Y-belt to the I-belt. In the course of subsequent transfers to further belts, damage to the surface of the bobbins, such as can be caused by acceleration, braking, pile-ups, etc., is assuredly prevented.

Details of the invention will be explained by means of the schematic representation of an exemplary embodiment.

DETAILED DESCRIPTION OF THE PREFERRED EMBODIMENT

Figure 1:
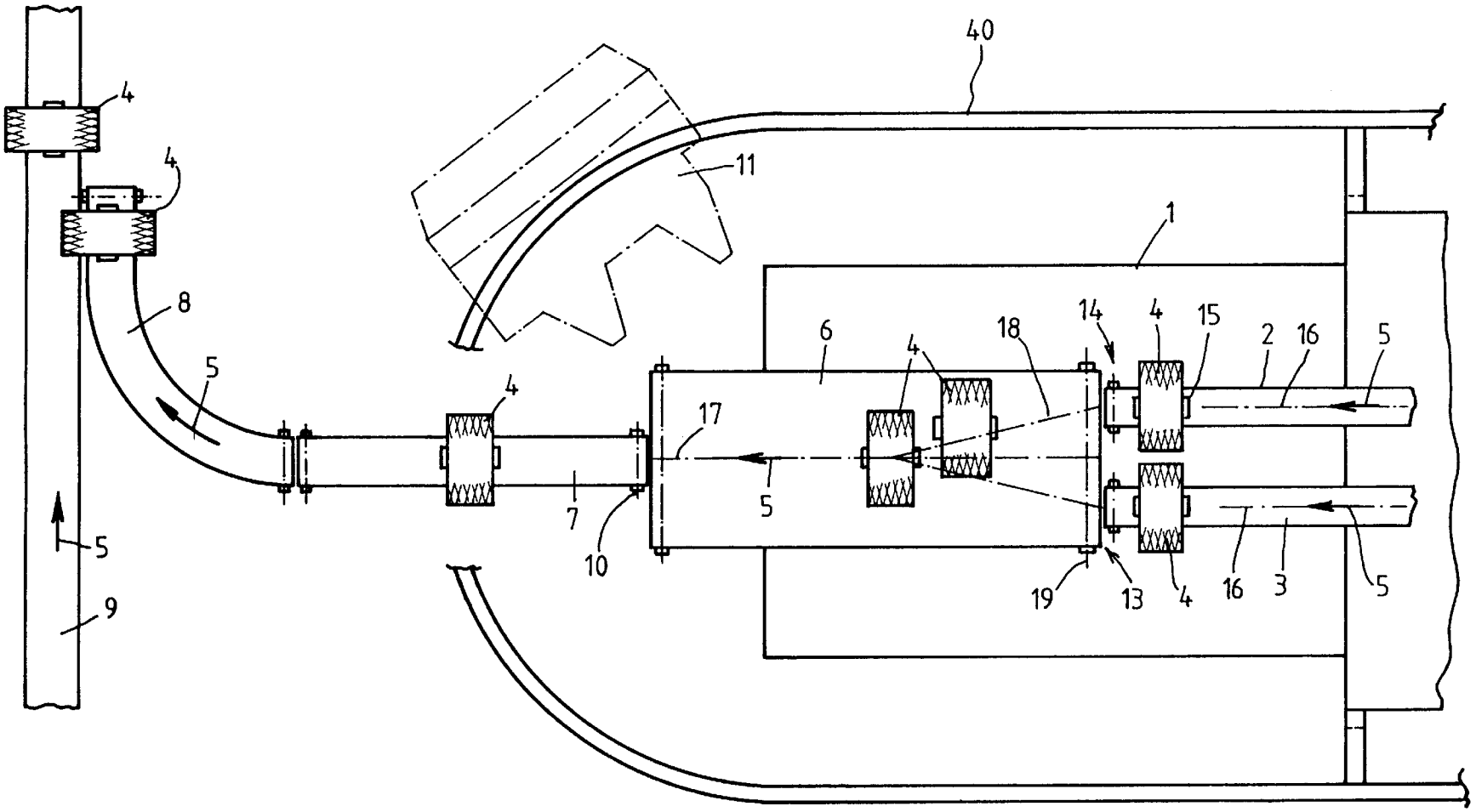
FIG. 1 is a schematic representation in top plan view of the Y-shaped junction/interface belt according to the preferred embodiment of the present invention, disposed for operation for receiving bobbins at the bobbin clearing area of a spinning machine with two parallel arranged delivery belts.
Figure 2:
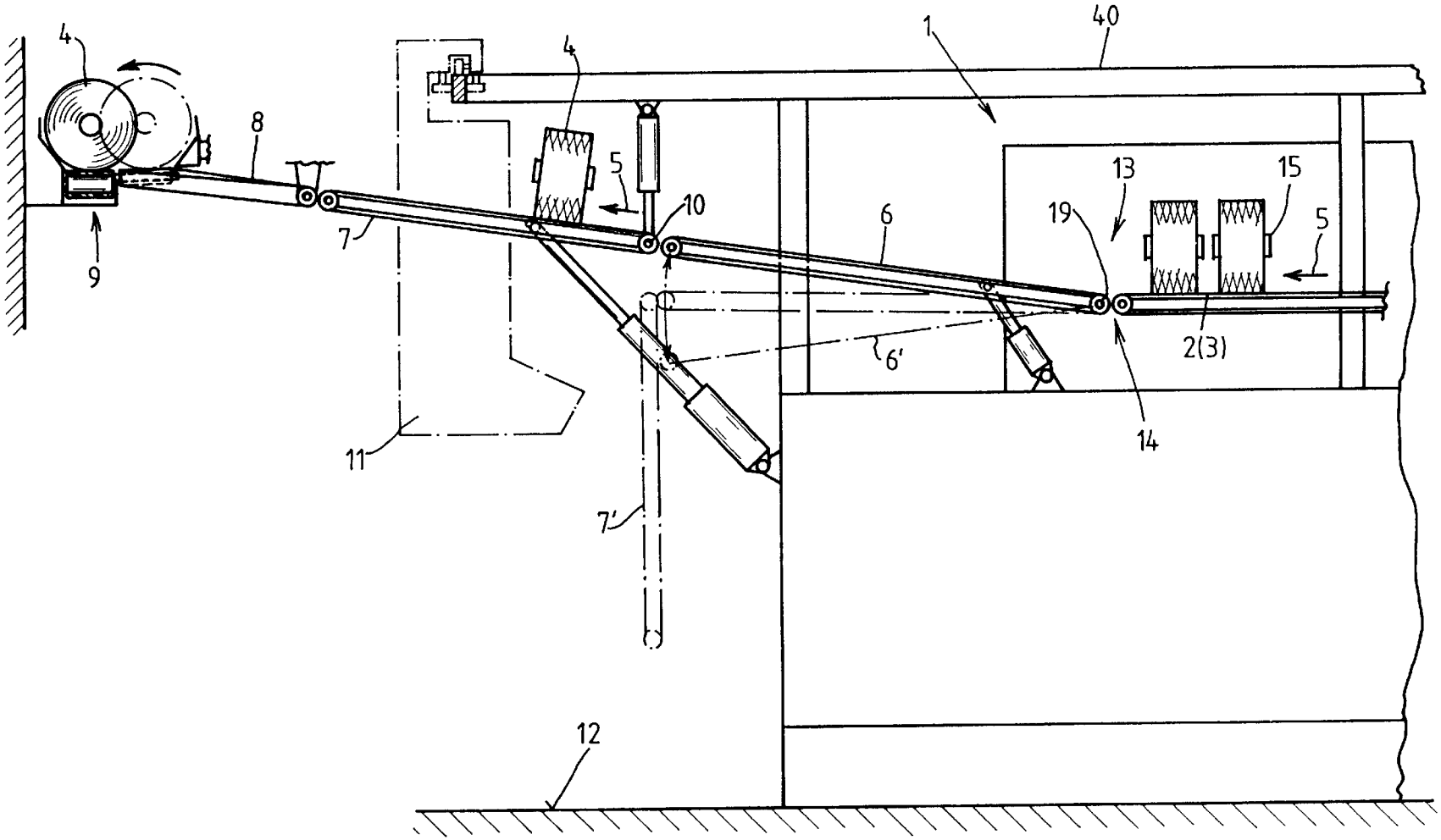
FIG. 2 is a lateral side elevational view of the spinning machine clearing area of FIG. 1.

An open-end spinning machine or open-end rotor spinning machine 1 is indicated only representatively in FIGS. 1 and 2 as a source of supply or means of producing wound yarn bobbins or cheeses, it being understood that the particular cheese supply or bobbin-producing apparatus from which cheeses or bobbins are delivered to the conveying system of the present invention is not a part of or any limitation on the potential applications of the present invention. At one end along the longitudinal axis or centerline of the machine, the open-end spinning machine 1 has two delivery belts, specifically a left delivery belt 2 and a right delivery belt 3, on which are collected finished cheeses 4 created at spinning stations (not shown). The delivery belts 2, 3 are cleared from time to time of the collected cheeses and, for this purpose, the delivery belts 2, 3 are alternatingly actuated in a delivery direction indicated by the arrows 5.

In accordance with the invention, the cheeses 4 from the delivery belt 2 or 3 reach an intermediate belt 6, hereinafter identified as a Y-belt, which spans laterally between the delivery belts 2, 3 to serve as an interface or junction therebetween. The Y-belt 6 transports the cheeses 4 further in the direction 5 to another intermediate belt 7, herein designated as an I-belt, which is pivotable into a position for transporting the cheeses to a curvilinear conveyor 8 which to a position alongside a collecting belt 9. At its terminal end area, the curvilinear conveyor 8 has a contour which induces the cheeses 4 to roll off laterally onto the collecting belt 9.

In general, the I-belt 7 is embodied to be pivotable around a shaft 10 extending horizontally and transversely in respect to the conveying direction 5, so that during normal operation of the open-end spinning machine 1 the I-belt may be pivoted into an inoperative position to avoid interference with the circulation of a piecing carriage 11, which is guided on a rail 40. This pivoted inoperative position of the I-belt is identified at 7' in FIG. 2.

As represented in FIG. 2, the transport of the cheeses 4 alternatingly from the right and left delivery belts 2, 3 via the Y-belt 6, the I-belt 7 and the curvilinear conveyor 8 to the collection belt 9 can take place at an obliquely upward angle to horizontal. In this manner, it is possible to transfer the cheeses 4 to the collection belt 9, which is preferably and normally positioned above head height over the mill floor 12.

Figures 3, 4:
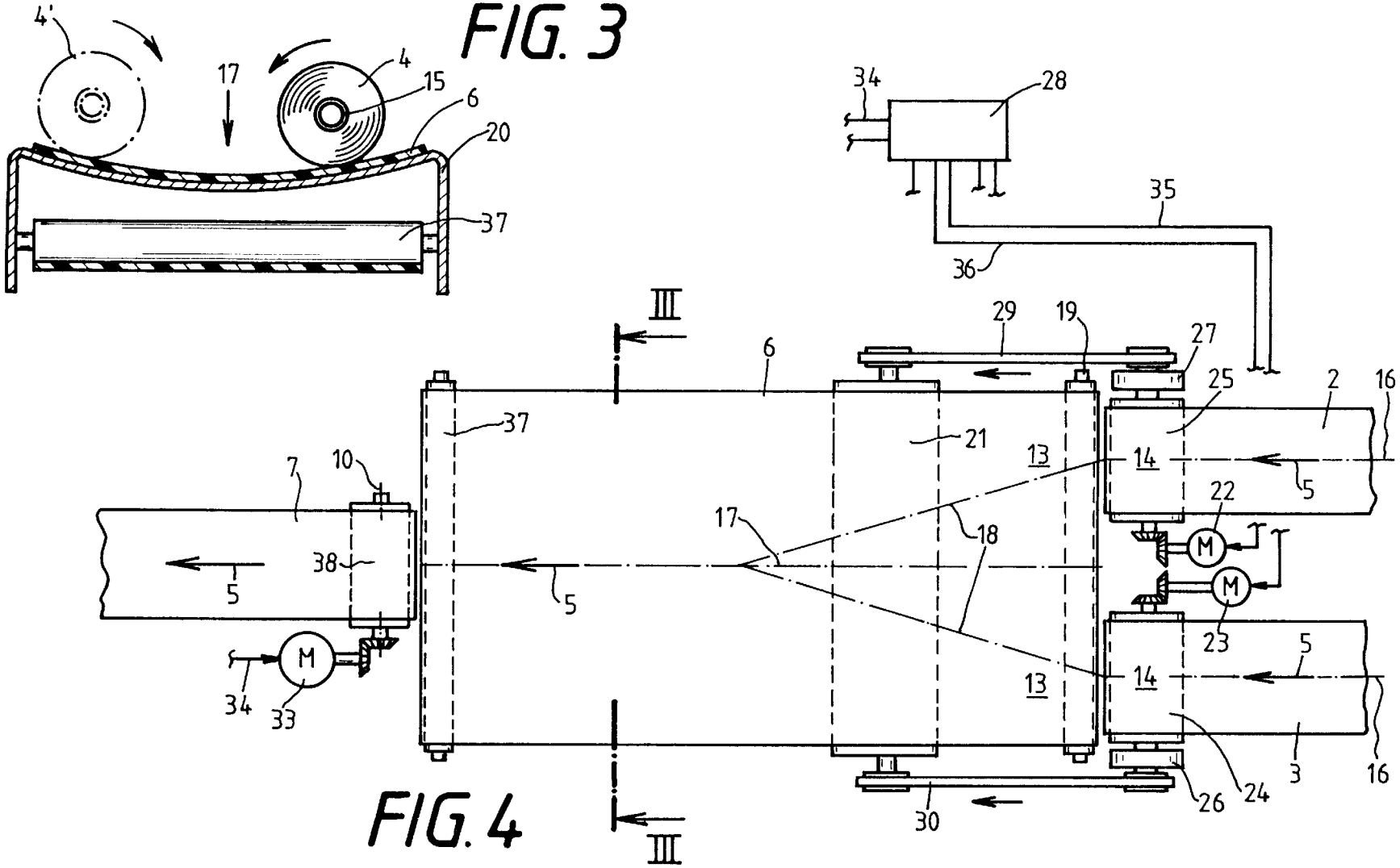
FIG. 3 is a vertical cross-sectional view of the Y-belt along the section III—III in FIG. 4.
FIG. 4 is another top plan view of the spinning machine clearing area of FIG. 1, showing a first embodiment of a drive system for the Y-belt.

As represented in FIGS. 1 and 4, the Y-belt 6 is embodied in accordance with the invention to be sufficiently wide so that its inlet, i.e. bobbin receiving, end 13 spans laterally across substantially the full width of the respective outlet ends 14 of the delivery belts 2 and 3. Each delivery belt 2, 3 receives the individual cheeses 4 lying in a substantially horizontal position with the bobbin tubes 15 oriented parallel and in alignment with the delivery direction 5 and therefore in parallel alignment with the longitudinal centerline 16 of the delivery belts 2 or 3.

In accordance with the present invention, the lengthwise extent of the interface/junction belt 6 is of a trough-like shape in its transverse cross-section (see FIG. 3) to define a longitudinal belt centerline 17 extending intermediately of and parallel with the belt centerlines 16 of the delivery belts 2, 3. In this embodiment, the trough is configured such that a bobbin 4 placed on the Y-belt 6 with its tube 15 oriented parallel with the delivery belt centerline 16, rolls into the center of the Y-belt 6. Thus, following the transfer of a cheese 4 from one of the delivery belts 2, 3 to the Y-belt 6 and its further movement as indicated in FIGS. 1 or 3, the cheese 4 rolls out of alignment with the previous belt centerline 16, approximately along an oblique line 18, into alignment with the belt centerline 17, so that, before reaching the end of the Y-belt 6, the cheese 4 lies centered on the Y-belt 6. Subsequently, the cheese 4 is transferred in the customary manner from the Y-belt 6 to the I-belt 7 and therefrom to the collection belt 9 via the curvilinear conveyor 8.

Synchronous operation of the several successive conveyor belts is important for the optimal operation of the present invention and, thus, the respective conveying delivery belts 2, 3, the interface or Y-belt 6, the I-belt 7, etc., should travel at the same surface speed during the time in which cheeses 4 are transferred so that each transferring belt surface and the accepting belt surface will have the same speed.

In accordance with the instant exemplary embodiment, the Y-belt 6 is disposed to be pivotable to a limited extent around a shaft 19 in the area of the outlets 14 of the delivery belts 2, 3. As a result, it is possible to embody the Y-belt 6 similar to the I-belt 7 as a passive uniting element or interface. The pivotable Y-belt 6 in particular can be positioned for automatic operation at the slight incline represented in FIG. 2 of the drawings. For manual operation, the Y-belt can be arranged with a slightly descending slope for making the bobbins accessible to operational personnel at a lower manipulation height, this position of the Y-belt 6 being indicated by 6' in FIG. 2.

As indicated, FIG. 3 represents a lateral cross section of the Y-belt 6. As shown, the conveying surface of the Y-belt rests on a trough-shaped support structure 20, so that the cheeses 4 or 4 ' delivered by means of the delivery belts 2 or 3 roll laterally of their lengthwise axes automatically to the belt centerline 17 for protection of their wound yarn surface.

A first embodiment of a synchronous drive arrangement for the several conveyor belts is represented in FIG. 4. As indicated in this exemplary embodiment, the delivery belts 2 and 3 have separate respective motor drives 22 and 23 which drive respective rollers 24 and 25 of the delivery belts 2, 3 by means of appropriate gears. In addition, the drives 22, 23 are connected to coupling devices 26 and 27, which are controlled by means of a control device 28. In turn, the coupling devices 26, 27 are connected with the drive roller 21 of the Y-belt 6 by means of suitable connecting means, for example toothed belts 29, 30.

Further similar embodiments of a synchronous drive arrangement are of course also possible. For example, the coupling devices 26, 27 can also be positioned in the immediate area of the drive roller 21 of the Y-belt 6. In place of the coupling devices, it is also possible to employ free-wheeling devices which prevent the respective conveyor belt 2 or 3, which is not being driven at a given time in the operation of the present invention, from being dragged along by the driven conveyor belt.

Figure 5:
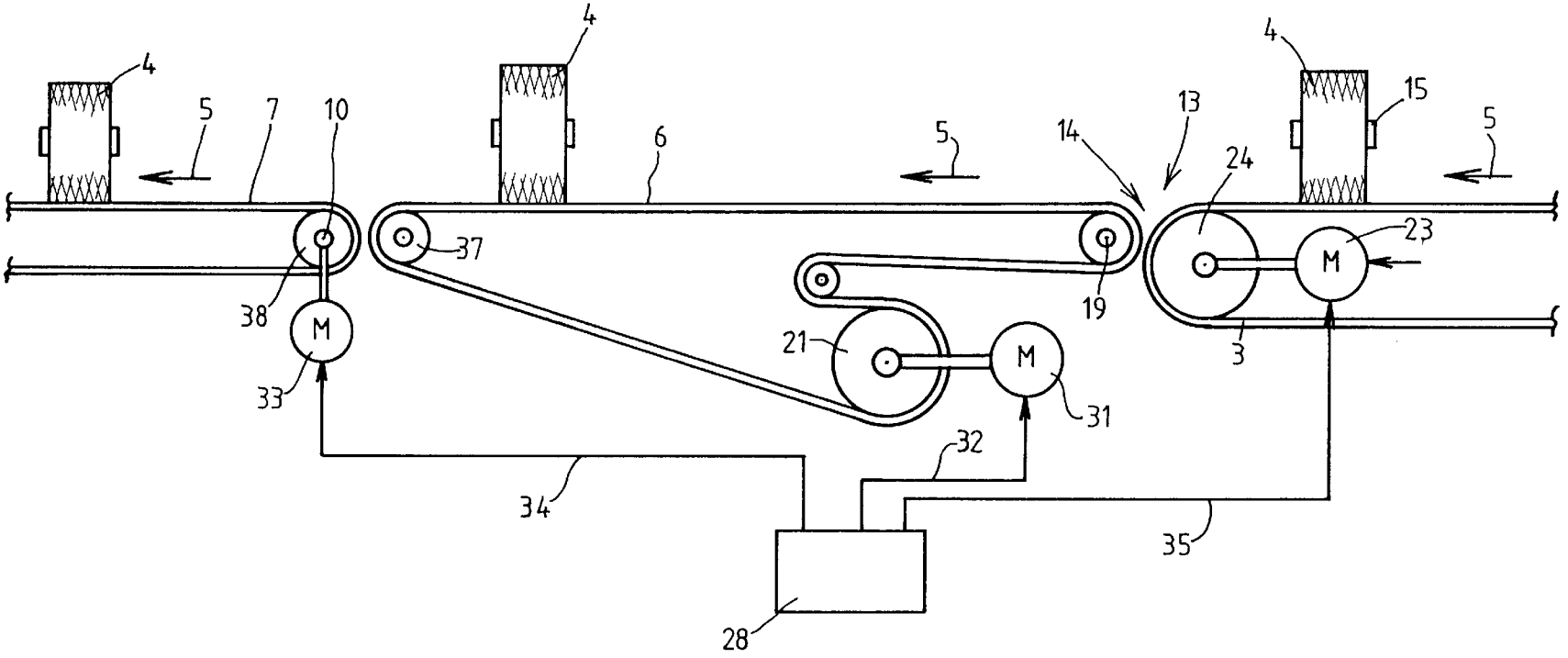
FIG. 5 is a side elevational view of the spinning machine clearing area of FIG. 1, showing an alternate embodiment of Y-belt drive system.

FIG. 5 shows another alternative variant for a synchronous drive of the delivery belts 2, 3, the Y-belt 6 and the I-belt 7. As indicated, the individual belts have separate respective drives 22, 23, 31, 33, which are connected by means of control lines 32, 34, 35 with a common central control device 28. A defined, i.e., controlled, operation of the sequentially arranged delivery belts at the same circulating speed is also possible with such an arrangement so that, hereagain, damage of the yarn surface of the bobbins during the transfer of the bobbins from one to the other belt is assuredly prevented.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A textile cheese conveying system comprising at least two delivery belts each having a bobbin delivery outlet end, a collecting belt having a bobbin receiving end, and an interface interposed between the outlet ends of the delivery belts and the inlet end of the collecting belt for transferring bobbins from the delivery belts to the collecting belt, the interface including an interface belt having a transverse extent spanning between the outlet ends of the delivery belts for receiving bobbins from both thereof, the interface belt being of a trough shape in transverse cross-section to define a central bobbin collecting depression extending longitudinally along the interface belt and for inducing bobbins transferred onto the interface belt to roll transversely into the depression, means for alternately actuating the delivery belts, and means for actuating the interface belt and the delivery belts substantially at the same speed.

2. The cheese conveying system in accordance with claim 1, wherein the means for alternately actuating the delivery belts comprising means for alternate free-wheeling actuation of the delivery belts.

3. The cheese conveying system in accordance with claim 1, wherein the means for alternately actuating the delivery belts comprising coupling means for alternate actuation of the delivery belts.

4. The cheese conveying system in accordance with claim 1, wherein the means for actuating the interface belt and the delivery belts substantially at the same speed comprises drive rollers for each of the interface belt and the delivery belts and a toothed belt drive for connecting the drive roller of the interface belt with the drive rollers of the delivery belts.

5. The cheese conveying system in accordance with claim 1, wherein the means for actuating the interface belt and the delivery belts substantially at the same speed comprises separate drives for the interface belt and the delivery belts and means for controlling the respective drives for the interface belt and the delivery belts to travel at the same surface speed.

6. The cheese conveying system in accordance with claim 1, wherein the interface belt is pivotably supported about a substantially horizontal shaft disposed orthogonally in respect to the longitudinal belt direction.

* * * * *